US007347356B2

(12) United States Patent
Fields et al.

(10) Patent No.: US 7,347,356 B2
(45) Date of Patent: Mar. 25, 2008

(54) APPARATUS AND METHOD FOR COIN COLLECTION AND ADVERTISING

(76) Inventors: Lundy S. Fields, 6640 Eastleigh Cir., Suwanee, GA (US) 30024; Jerry L. Shepherd, 130 White Colums Dr., Alpharetta, GA (US) 30004

( * ) Notice: Subject to any disclaimer, the term of this patent is extended or adjusted under 35 U.S.C. 154(b) by 476 days.

(21) Appl. No.: 10/735,347

(22) Filed: Dec. 12, 2003

(65) Prior Publication Data

US 2004/0124099 A1 Jul. 1, 2004

Related U.S. Application Data

(60) Provisional application No. 60/433,406, filed on Dec. 13, 2002.

(51) Int. Cl.
*A47G 29/00* (2006.01)

(52) U.S. Cl. ..... 232/4 R; 232/1 D; 206/0.81

(58) Field of Classification Search ..... 232/4, 232/1 D; 206/0.81, 0.815; 446/8; 705/1, 705/14, 35

See application file for complete search history.

(56) References Cited

U.S. PATENT DOCUMENTS 2,731,226 A * 1/1956 Ricciardi ..... 248/450
4,023,728 A * 5/1977 Gamberg ..... 232/4 R
D304,644 S * 11/1989 Silcox ..... D99/36
4,878,867 A 11/1989 Dworman et al.
5,069,645 A 12/1991 Dworman et al.
5,301,942 A * 4/1994 Lacrosse ..... 273/138.3
5,465,909 A * 11/1995 Roth ..... 232/1 D
6,116,977 A * 9/2000 Tanny et al. ..... 446/8
6,494,776 B1 12/2002 Molbak
6,602,125 B2 8/2003 Martin
2004/0054544 A1* 3/2004 Sloot ..... 705/1
2004/0106369 A1* 6/2004 Shannon ..... 453/3

OTHER PUBLICATIONS

UNICEF, Trick-or-Treat for UNICEF, Internet Website www.unicefuse.org, undated.
www.pushkes.com, Internet Website www.Pushkes.com, undated.
ADCAN, "Nothing Gets Opened Like AdCan", undated.

* cited by examiner

*Primary Examiner*—William L. Miller
(74) *Attorney, Agent, or Firm*—Gardner Groff Greenwald & Villanueva, PC

(57) ABSTRACT

An apparatus for simultaneously collecting and retaining coins and advertising or promoting a commercial product or services as well as advertising or promoting the operations of a charitable entity. The apparatus is preferably cylindrical and lightweight, and includes an removable end and opening for receiving coins. Advertising material or other printed information, both from charitable and commercial entities, is displayed on the external surface of the apparatus. Product samples, advertising, promotion or other materials are placed inside the container prior to distribution. Upon receipt by the consumer, materials within the container are removed and the container is used as a storage device, preferably for coins that are ultimately returned to an automated counter for donation, at least in part, to a charitable organization.

18 Claims, 1 Drawing Sheet

APPARATUS AND METHOD FOR COIN COLLECTION AND ADVERTISING

CROSS-REFERENCE TO RELATED APPLICATIONS

This application claims priority to U.S. Provisional Patent Application Ser. No. 60/433,406 by Fields, et al., filed Dec. 13, 2002, which application is hereby incorporated herein by reference in its entirety.

FIELD OF THE INVENTION

The present invention relates to advertising, promotion and coin collection devices. The invention relates to the partnering of business or commercial entities and charitable institutions, for both collection of charitable donations and business communication efforts.

BACKGROUND OF THE INVENTION

Coin retention devices are known in the art. The most common coin collection device is probably the conventional "piggy bank". A substantial number of variations of these coin holders have been manufactured and sold. One example is shown in U.S. Pat. Nos. 4,878,867 and 5,069,645, both issued to Dworman, et al., on Nov. 7, 1989 and Dec. 3, 1991, respectively. The U.S. Pat. No. 5,069,645 discloses an elongated cylindrical tubular coin bank with a removable cap having a coin slot in the upper part of the cap. Such coin banks are designed for accepting and holding coins, as well as manual coin removal by the owner.

Automated coin sorting and redemption machines are known in the art. Some of the more well known commercial automated sorting and redemption machines are those of Coinstar, Inc. of Bellevue, Wash. (U.S.A.). Examples of inventions relating to automated coins counting and sorting are illustrated in U.S. Pat. No. 6,494,776 B1, issued on Dec. 17, 2002 to J. Molbak and U.S. Pat. No. 6,602,125 B2, issued on Aug. 5, 2003 to D. Martin. These inventions are directed to the machinery and related components for automatic coin counting and sorting, as well as coupon dispensing.

Known devices and methods are primarily directed to either the manual collection and storage of coins, or automated coin handling such as counting and sorting. Opportunities for the alignment and synergy of these processes, as well as interrelations with other business opportunities, such as commercial marketing and charitable donations have not been resolved in the art.

SUMMARY OF THE INVENTION

An object of example forms of the invention is to provide a means for collecting money for charitable institutions that simultaneously provides value to commercial entities such that a portion or all of the operating costs will be funded by the commercial entity.

Another object of example forms of the invention is to provide a means for simultaneously collecting coins, sampling products and advertising for services or products.

A further object of example forms of the invention is to provide a means for simultaneously collecting coins, sampling products and promoting products or services.

Yet another object of example forms of the invention is to provide a means for simultaneously collecting coins and advertising for services or products.

Still another object of example forms of the invention is to increase the rate of circulation of coins, thereby reducing the rate at which new coins must be minted.

In example embodiments, the present invention is an apparatus for simultaneously collecting and retaining coins and advertising or promoting a commercial product or services as well as advertising or promoting the operations of a charitable entity. The apparatus is a means for retaining coins, preferably cylindrical and lightweight, and includes an opening for receiving deposit of coins. Advertising material or other printed information is displayed on the external surface of the coin collector. The advertising material or contact information is that of a charitable entity and a business or commercial entity.

DESCRIPTION OF THE DRAWING FIGURES

DESCRIPTION OF EXAMPLE EMBODIMENTS

Figure 1:
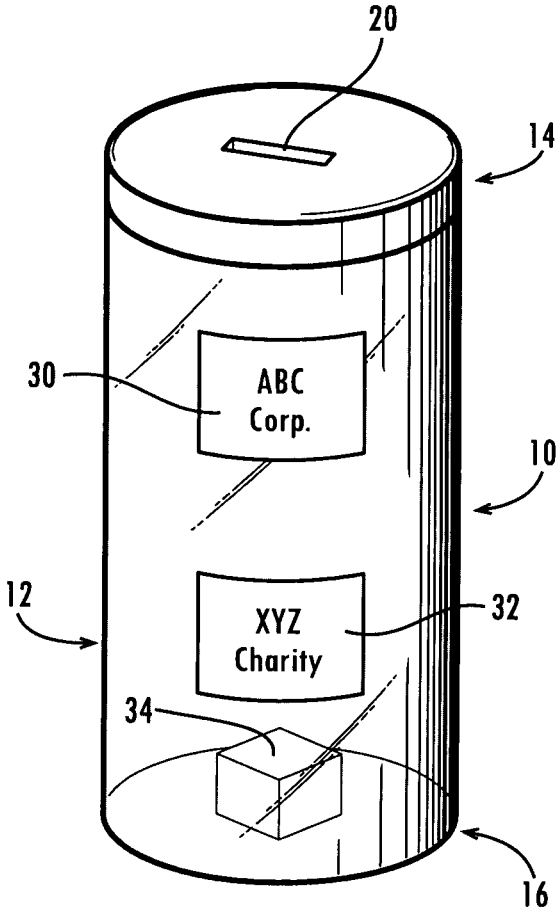
FIG. 1 is a perspective view of an apparatus according to an example embodiment of the invention
Figure 2:
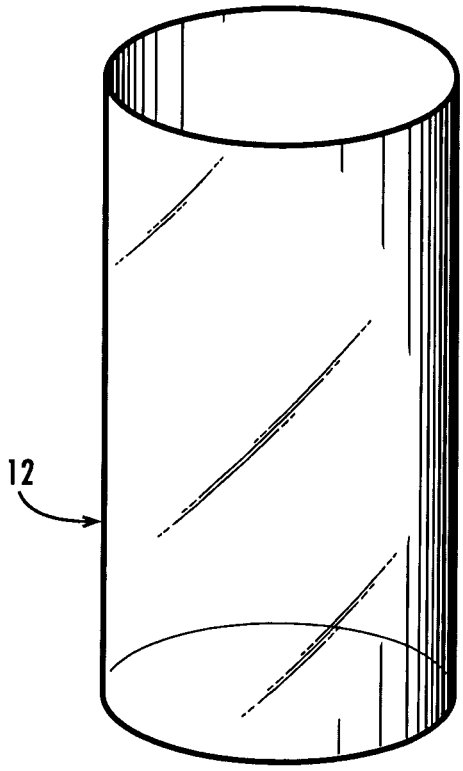
FIG. 2 is a perspective view of a portion of the apparatus of FIG. 1.
Figure 3:
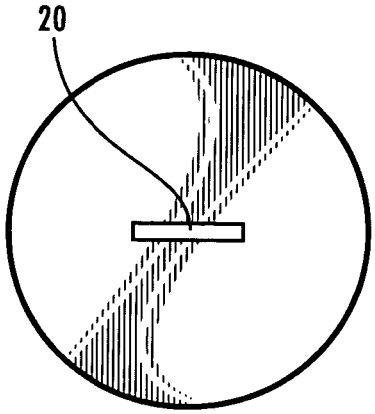
FIG. 3 is a top view of the apparatus of FIG. 1.
Figure 4:
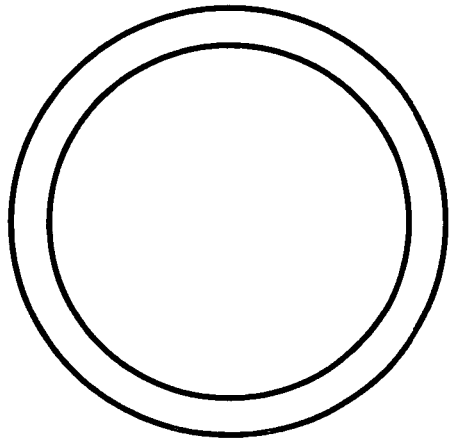
FIG. 4 is a bottom view of the apparatus of FIG. 1.

People typically do not enjoy the handling of coins or metallic monetary change. In particular, in the United States, the vast majority of the coins in circulation are valued at less than one U.S. dollar. This low value and nominal utility, coupled with their weight and discomfort in pockets and purses, result in most coins being taken out of circulation by people leaving them in their homes. Coins can be found in decorative coin collectors, old jars, tin cans and a wide variety of containers in U.S. homes. While the value of individual coins is small, the value of large quantities of accumulated coins is substantial, and the value of millions of households' coin collections is most probably quite substantial. This lack of coin circulation has a negative effect on the economy and causes the government to mint additional coins unnecessarily. Thus, there is a need to find a method of encouraging people to bring coins back into circulation.

Some companies have attempted to capitalize on consumers' lack of desire to roll coins to be re-deposited into the bank. For example, Coinstar, Inc. (Bellevue, Wash., United States) has developed a machine that allows consumers to deposit large quantities of coins and have the coins automatically sorted, with the consumer receiving a large portion of the deposited amount in cash, while Coinstar retains a handling and sorting fee. Consumers are also given the option to donate their coins to charity and walk away with a tax-deductible receipt. These machines can be found in select grocery stores or supermarkets, such as Kroger, typically in the entrance or exit path of the store. However, while Coinstar machines and others like them provide a valuable service, the percentage of consumers that utilize the machines routinely could be dramatically improved.

The use of coin redemption technology has traditionally been focused on the coin redemption industry. However, widespread distribution of collection and retention devices provides an opportunity for further communication efforts. In particular, products and services may be marketed by coupling commercial business marketing efforts (separate from coin redemption businesses) with coin collection and redemption devices. Today, brand loyalty is at an all-time low. Consumers purchase only if there is a continuing incentive to buy. Advertising and promotion programs have so overwhelmed the consumer that marketing communications are often lost in this overwhelming sea of activity. Even when properly focused, nearly 90% of all direct mail is not even opened by the recipient. Thus, marketers are continually seeking methods of heightening consumer awareness and generating product trials with response rates to justify the investment.

In yet a different world, charitable organizations, such as the American Diabetes Association, are perpetually faced with the challenges of encouraging donations to continue the wonderful community services that they render or facilitate. Avenues for reaching people to tell the story of the charity are always being sought. However, often the charity is forced to reinvest some of the funds collected in order to reach more people. Therefore, there is a need for charities to find new methods of communicating with consumers, as well as finding ways to minimize the costs to the charity of this communication.

The present invention meets some of the needs of the coin redemption industry, the government, charities and marketers in commercial businesses as outlined above. The invention is an apparatus for simultaneously collecting and retaining coins and advertising or promoting a commercial product or services as well as advertising or promoting the operations of a charitable entity. The apparatus is a means for retaining coins, preferably cylindrical and lightweight, and includes an opening for receiving deposit of coins. Advertising material or other printed information is displayed on the external surface of the coin collector. Advertising or product samples may also be placed inside the container. The advertising material or contact information is preferably that of a charitable entity and a business or commercial entity.

The coin collection and redemption device will include advertising from commercial entities as well as information from at least one charitable organization. In practice, the device will be distributed to consumers, preferably via the U.S. Postal Service or via attachments to regular newspaper delivery. Consumers will open the device and remove the contents, thereby achieving the product sampling or advertising objectives of the commercial entity. Then, over time, consumers will use the device as a coin holder. Preferably, once full, the consumer will bring the device to a coin redemption machine, which will accept the coins and return the consumer with a receipt for a tax-deductible charitable donation.

After the consumer returns the coin collector and coins to the automated counting machine, the machine is preferably designed to provide a receipt to the consumer showing the amount donated. In a preferred embodiment, the consumer will be allowed to elect to receive a portion of the cash back, while donating the selected amount to the designated charity. Further, a receipt will be printed designating the amount donated to the charity, providing the consumer a receipt useful for tax deduction purposes. Optionally, coupons for the commercial entity that sponsored the manufacturer may be printed at the same time of coin deposit from the sorting and counting machine.

Commercial businesses will likely be willing to finance all or most of the costs of producing and distributing the coin collection and retention device, thereby reducing or eliminating the cost of the charitable entity in securing the donations. In addition to the low cost of this collection technique, the charitable entity will benefit by achieving a broader reach into consumer households to disseminate important public service messages and to solicit donations. Moreover, the placement of product samples in this intriguing device better ensures a consumer will actually open the device and see the charitable literature, in contrast to conventional direct mailing programs.

Commercial entities or companies may utilize the container in a number of ways to generate business. For example, advertising or promotional material, or company contact information, may be printed on the exterior of the container. Similarly, the container may have material inside, such as advertising materials, promotion materials, coupons, or combinations of these materials.

Moreover, the commercial entity benefits merely by the association with a charitable entity, in that the image of the commercial entity is enhanced. In addition to general reputation advantages, consumers are more likely to open a commercial container affiliated with a respectable charity than those that are solely directed to selling more product. Furthermore, associating commercial businesses in a particular field with the charities in that field (e.g., a diabetic blood testing supplier with the American Diabetes Association) may provide even more synergistic advantages.

The coin collection and retaining means is preferably a rigid container 10 for protection of the contents during shipping. More preferably, the container is cylindrical. For example, the container preferably comprises one or more sidewalls 12, extending between a first end 14 and a second end 16. The uniformity of a cylindrical shape lends itself to automated coin processing machines. In addition, uniform cylindrical shapes offer advantages in display as coin containers, storage and distribution. However, the device may be made into a wide variety of shapes, such as conical and cubical. Corporate advertising material 30 and the like, and/or promotional material 32 for charitable entities is preferably displayed, as by printing, labeling or otherwise, in or on the container 10. Material 34, such as advertising materials, promotional materials, coupons, product samples, and the like are optionally placed in or on the container 10.

Typical access to the container may be allowed via a single opening 20 having a dimension sufficiently sized to comfortably allow coins to be deposited but sufficiently small or appropriately shaped to prevent coins from accidentally falling out in the event the collector is positioned upside down. The coin insertion opening is preferably a linear centered slot or slit, having a dimension of less than about 3 centimeters in length and less than about 5 millimeters in width.

One end of the coin collection device is preferably removable by the consumer, to allow for the consumer to remove the contents that were in the device as delivered (e.g., commercial advertising materials, charity information, coupons or product samples). In addition, this access allows for removal of coins, for example, to allow access and removal in the event one or more precious coins has been inadvertently placed into the container. In a preferred embodiment, the removable end is a light-weight plastic lid, which is press-fit or interference-fit onto the coin collection and retention device, thereby allowing for easy removal and replacement.

Consumers will typically physically transport their coin collection device to a counting and receiving machine. However, the initial distribution of the coin collection device may occur most efficiently via the U.S. Postal System, or other mail services. Accordingly, the coin collection device is preferably made of materials that are relatively lightweight, while sufficiently durable to retain coins and survive shipping procedures. In one preferred embodiment, the coin collection device weighs less than about 50 grams.

Separate and apart from the weight and transport considerations, the container is preferably manufactured from materials that are either sufficiently durable for reuse or are appropriately designed for recycling after disposal. A preferred container material is spiral wound cardboard, because of low manufacturing costs, shipping costs and sufficient structural support. Other preferred materials include lightweight polymeric materials such as polypropylene, polyethylene or polyethylene terephthalate. Optionally, at least a portion of the container is transparent or translucent, to permit observation of how full the container is. The bottom of the container is preferably a light metal, again for structural integrity, as well as initial sound resonance when depositing the first coins.

While it is preferred for consumers to use the coin collection and retention device to collect coins for future deposit into an automated sorting mechanism, some consumers will probably use the container for other purposes. The container will lend itself generally to storage of smaller items, such as pencils, stationary items such as paper clips, personal care products for traveling, and small consumable hardware such as screws, nuts and bolts.

While direct-to-consumer mailing is a preferred avenue of distribution of the containers, other options are also contemplated. For example, the coin collection and retention containers may be distributed at the supermarkets or grocery stores in which coin redemption machines are located. In addition, charitable organizations may distribute the containers at their own events and gatherings. Alternatively, the containers may be distributed to consumer households via hanging bags temporarily affixed to mailboxes or to the front doors of homes.

The previous disclosure will enable one having ordinary skill in the art to practice the invention. The invention has been described in detail, with reference to certain preferred embodiments, in order to enable the reader to practice the invention without undue experimentation. However, a person having ordinary skill in the art will readily recognize that many of the components and parameters may be varied or modified to a certain extent without departing from the scope and spirit of the invention. Furthermore, titles, headings, or the like are provided to enhance the reader's comprehension of this document, and should not be read as limiting the scope of the present invention. Accordingly, the intellectual property rights to this invention are defined only by the following claims and extensions and equivalents thereof allowed under applicable law.

That which is claimed is:

1. A method of conducting business, comprising the steps of:

distributing coin collection and retention devices to consumers, said devices receiving coins;

advertising, promoting or providing information related to at least one commercial product or service of at least one commercial entity on the exterior of said coin collection and retention devices;

advertising, promoting or providing information relating to at least one charitable entity on the exterior of said coin collection and retention devices;

accepting said coin collection and retention devices containing said coins from said consumers; and providing said consumers with a report of the value of said coins accepted and the estimated amount of charitable contribution made.

2. The method of claim 1, further comprising the step of distributing said charitable amounts from said coins collected to said at least one charitable entity.

3. The method of claim 2, wherein said at least one commercial entity provides the majority of funding for said method.

4. The method of claim 1, further comprising the step of advertising, promoting or providing information relating to said at least one charitable entity on the interior of said coin collection and retention devices.

5. The method of claim 1, further comprising the step of providing at least one sample product free of charge in said coin collection and retention devices.

6. A method of increasing the circulation rate of coins in the economy and reducing the need to mint new coins, comprising the steps of:

distributing coin collection and retention devices to consumers, said devices receiving coins, wherein said collection and retention devices provide incentives to said consumers to return said devices because at least a portion of the amount of said coins collected is donated to at least one charitable entity;

obtaining at least a portion of the funding for said coin collection and retention devices and related distributing and collecting by allowing at least one commercial entity to advertise or promote at least one product or service on said devices;

accepting said coins from said consumers; and distributing charitable amounts of said coins collected to said at least one charitable entity.

7. The method of claim 6, further comprising the step of advertising, promoting or providing information related to said commercial product or service of said at least one commercial entity on the exterior of said coin collection and retention devices.

8. The method of claim 6, wherein said at least one commercial entity provides the majority of said funding for said method.

9. The method of claim 6, further comprising the step of accepting said coin collection and retention devices containing said coins from said consumers.

10. The method of claim 6, further comprising the step of providing at least one sample product free of charge in said coin collection and retention devices.

11. The method of claim 6, further comprising the steps of:

accepting said coin collection and retention devices containing said coins from said consumers;

advertising, promoting or providing information related to said commercial product or service of said at least one commercial entity on the exterior of said coin collection and retention devices, wherein said at least one commercial entity provides the majority of said funding for said method; and providing at least one sample product free of charge on the interior of said coin collection and retention devices.

12. A method of conducting business, comprising the steps of:

distributing coin collection and retention devices to consumers, said devices receiving coins;

advertising, promoting or providing information related to at least one product, at least one service, or at least one product and service of at least one commercial entity on said coin collection and retention devices, wherein said at least one commercial entity provides the majority of funding for said method; and advertising, promoting or providing information relating to at least one charitable entity on said coin collection and retention device.

13. The method of claim 12, further comprising the step of accepting said coin collection and retention devices containing said coins from said consumers.

14. The method of claim 12, further comprising the step of advertising, promoting or providing information relating to said at least one charitable entity on the exterior, the interior, or the exterior and the interior of said coin collection and retention devices.

15. The method of claim 12, further comprising the step of providing at least one sample product free of charge in said coin collection and retention devices.

16. A method of conducting business, comprising the steps of:

distributing coin collection and retention devices to consumers, said devices receiving coins;

advertising, promoting or providing information related to at least one product, at least one service, or at least one product and service of at least one commercial entity on said coin collection and retention devices;

advertising, promoting or providing information relating to at least one charitable entity on said coin collection and retention devices;

accepting said coins from said consumers; and providing said consumers with a report of the value of said coins accepted and the estimated amount of charitable contribution made.

17. The method of claim 16, further comprising the step of distributing said charitable amounts from said coins collected to said at least one charitable entity.

18. The method of claim 16, wherein said at least one commercial entity provides the majority of funding for said method.

* * * * *